US005991419A

United States Patent [19]

Brander

[11] Patent Number: 5,991,419

[45] Date of Patent: Nov. 23, 1999

[54] BILATERAL SIGNAL PROCESSING PROSTHESIS

[75] Inventor: Richard Brander, Chicago, Ill.

[73] Assignee: Beltone Electronics Corporation, Chicago, Ill.

[21] Appl. No.: 08/841,068

[22] Filed: Apr. 29, 1997

[51] Int. Cl.[6] ..... H04R 25/00

[52] U.S. Cl. ..... 381/312; 381/315

[58] Field of Search ..... 381/312, 313, 381/314, 315, 316, 321, 326, 322

[56] References Cited

U.S. PATENT DOCUMENTS

| | | | |
|---|---|---|---|
| 3,894,195 | 7/1975 | Kryter | 179/107 |
| 4,334,315 | 6/1982 | Ono et al. | 381/315 |
| 5,202,927 | 4/1993 | Topholm | 381/315 |
| 5,479,522 | 12/1995 | Lindermann et al. | 381/312 |
| 5,680,466 | 10/1997 | Zelikovitz | 381/313 |
| 5,721,783 | 2/1998 | Anderson | 381/312 |
| 5,751,820 | 5/1998 | Taenzer | 381/312 |
| 5,757,932 | 5/1998 | Lindermann et al. | 381/316 |
| 5,835,610 | 11/1998 | Ishige et al. | 381/315 |

FOREIGN PATENT DOCUMENTS

| | | | |
|---|---|---|---|
| WO 97/14268 | 10/1995 | WIPO | H04R 25/00 |

*Primary Examiner*—Curtis A. Kuntz
*Assistant Examiner*—Rexford N Barnie
*Attorney, Agent, or Firm*—Rockey, Milnamow & Katz Ltd.

[57] ABSTRACT

A bilateral hearing instrument incorporates first and second units which could, for example, be worn by an individual having hearing deficiencies in both ears. One unit includes an audio input transducer coupled to a transceiver. The second unit includes a second audio input transducer coupled to a second transceiver which is coupled, wirelessly, to the first transceiver. An output of the second transceiver is coupled to an input port of a signal processor. A second input to the signal processor comes from the second audio input transducer. One output from the signal processor Is transmitted Tirelessly to the first unit for presentation to one ear of the user. The other output of the processor is coupled to an output transducer for the user's second ear. A single signal processor generates representations of audio output signals for both of the user's ears.

13 Claims, 2 Drawing Sheets

BILATERAL SIGNAL PROCESSING PROSTHESIS

FIELD OF THE INVENTION

The invention pertains to hearing aids. More particularly, the invention pertains to a hearing aid prosthesis which process signals provided via microphones on both sides of a user's head.

BACKGROUND OF THE INVENTION

Hearing aids have long been recognized as being useful and effective in attempting to minimize the effects of hearing deficiencies. Often times a user will wear only a single hearing prosthesis. There are times however where users will wear a prosthesis in each ear due to that user's particular hearing deficiencies.

In an individual with normal hearing, processing of the audible, received signals takes place in the user's brain. Hence, such an individual receives processed information and cues from both ears which enable the individual to perceive the direction of signal source. In addition, signals from two different sources, separated in azimuth will be processed in a way that the user receives information and cues as to the relative location of each of the sources using inputs from both sources that are impinging on both ears simultaneously. This capability helps the individual to separate a desired signal from an undesired signal or noise.

It would be desirable to impart processing functionality for a user wherein dual prostheses are being used simultaneously with one located in or at each ear. Preferably, such processing will contribute to enhanced directionality, cancellation of off-axis noise or spatial separation of the received signals beyond that which is present with two independent prosthesis.

SUMMARY OF THE INVENTION

A bilateral, hearing aid system processes signals provided by microphones on both sides of a user's head without requiring that wires cross the user's head. A wireless link is provided to couple signals from one side to the other. A signal processor operates, in one embodiment, on both signals to produce, for example, enhanced directionality, cancellation of off-axis noise, or spatial separation Hearing aids worn in or near each ear of a user each contain one or more microphones. A conditioned microphone signal is formed for each ear by processes such as amplification, summation, and analog-to-digital conversion. In one embodiment, a conditioned microphone signal on each side modulates a carrier and is transmitted to the opposite side where it is received and demodulated to form a remote signal.

A signal processing unit on at least one side receives both the conditioned microphone signal from that side (the local signal) and the remote signal from the opposite side. The signal processor uses signal processing algorithms operating on these signals to produce an enhanced signal. The enhanced signal is conditioned by such processes as digital-to-analog conversion, pulse width modulation, or pulse density modulation, and fed to a miniature speaker (hearing aid receiver) to produce sound in the user's ear canal.

In yet another embodiment, a conditioned microphone signal on one side modulates a carrier and is transmitted to the opposite side (the second side) where it is received and demodulated to form a remote signal. A signal processing unit on the second side receives both the conditioned microphone signal from that side (the local signal) and the remote signal. The signal processor uses signal processing algorithms to operate on these signals to produce enhanced signals for both sides. The enhanced signal for the first side is used to modulate a carrier and is transmitted to the first side where it is received and demodulated. On both sides the signal can be conditioned by such processes as digital-to-analog conversion, pulse width modulation, or pulse density modulation and fed to a miniature speaker (hearing aid receiver) on that side to produce sound in the user's ear canal on that side.

Signal processing algorithms for producing enhanced signals can include one or more of the following:

1. Adaptive reduction of noise from an off-axis noise source. Signals from a source in the front of the user will have the same magnitude and phase on both sides while signals from an off-axis noise source will differ in magnitude and phase on the two sides. By taking the difference of the microphone signals from the two sides, a signal consisting primarily of components from the off-axis noise source is developed. This reference signal is used by an adaptive filtering algorithm to subtract components in the microphone signal that are correlated with the reference signal.
2. Fixed reduction of noise from either the near side or the far side (but not both at the same time). Signals from a source on the near side that arrive at the far side differ in magnitude and phase from those that arrive at the near side by a frequency dependent transfer function that is a function of the user's head geometry. By subtracting the remote signal multiplied by the above transfer function from the local signal, signals from the far side are reduced. By subtracting the remote signal multiplied by he inverse of the above transfer function from the local signal, signals from the near side are reduced.
3. Enhanced source separation. Signals at the two ear locations from various source locations will differ in magnitude and phase by an amount that depends on source location. By determining the difference between the signals at the two microphones and using this signal to enhance magnitude and phase differences, the source array is perceptually spread out.
4. Other algorithms can be used to enhance the signals provided to the user based on microphone signals received at the two ear locations without departing from the spirit and scope of the invention.

The signals are transferred between signal paths by the wireless communication link. For practical use in hearing aids, the transceivers for the wireless communication link preferably exhibit the following functional characteristics:

1. Audio bandwidth (100 to 6000 Hz), simultaneous independent communication in both directions.
2. Transmission distance in the range from 10 to 20 cm.
3. Transfer function independent of transmission distance within this range.
4. Well controlled transfer function with phase errors corresponding to time errors of less than 10 microsecond.
5. No interference from other radiation sources.
6. Transceiver volume (each side) of less than 30 $mm^3$.
7. Current drain from a single cell (each side) of less than 500 micro amp.
8. Operational supply voltage range of 1.10 to 1.50 volts.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
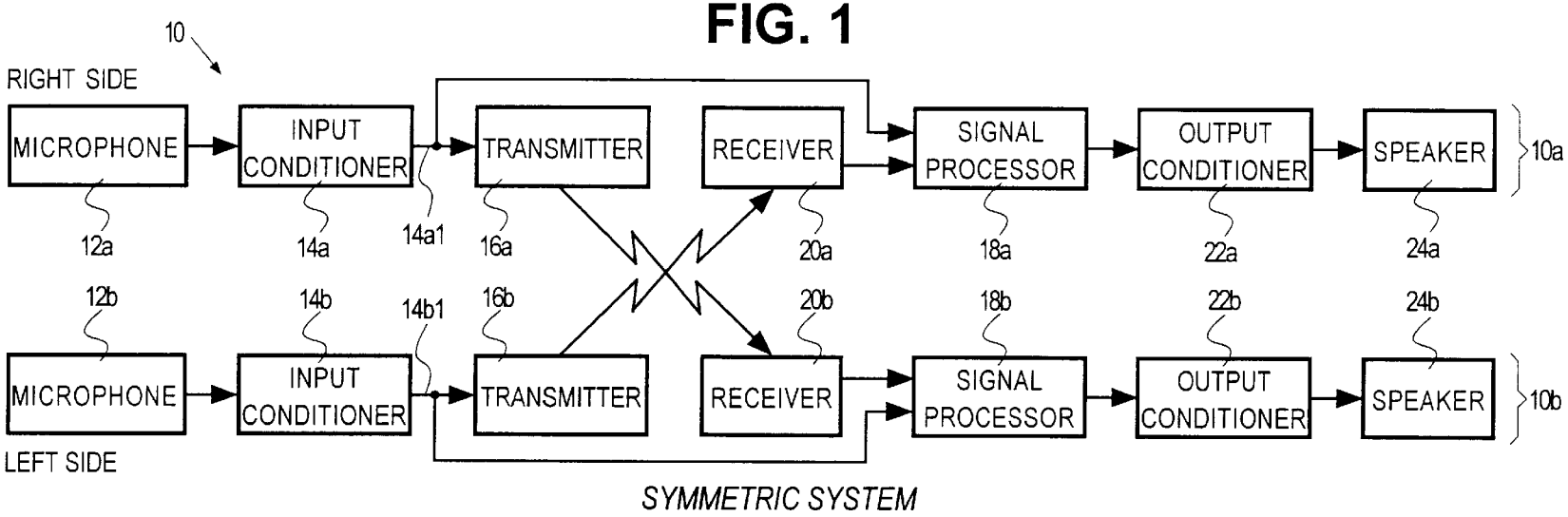
FIG. 1 is a block diagram schematic of a binaural hearing system which incorporates signal processors for each output unit.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

A symmetric binaural hearing system 10 is illustrated in block diagram form in FIG. 1. The system 10 includes two similar units 10*a*, 10*b*.

The system 10 includes microphones 12*a*, 12*b* which would be worn on each side of the user's head adjacent for example to the user's respective ear. Input conditioners 14*a*, 14*b* are coupled to respective microphones 12*a*, 12*b* to provide input conditioning of a type used with hearing aid microphones.

Each of the conditioners is coupled to a respective transmitter 16*a*, 16*b* as well as to a respective signal processor 18*a* and 18*b*. Use of the transmitter 16*a*, 16*b* means that the respective conditioned signals on the lines 14*a*1 and 14*b*1 can be presented to the other signal processor respectively 18*b*, 18*a* without any need for wires to cross the user's head.

Modulated signals from each of the transmitter 16*a*, 16*b* are received by receivers associated with the opposite unit, such as receivers 20*b* and 20*a*. The receivers demodulate the received RF signals and couple the respective demodulated signals to the local signal processor 18*a*, 18*b*.

The local signal processor incorporates signal processor algorithms for the purpose of adaptively reducing noise from an off axis source. In addition, processing can include a fixed reduction of noise from either the near side or the far side, enhanced source separation or other forms of processing which enhance the signals received by the microphones 12*a*, 12*b* and provide the user with an enhanced quality of processed audio.

The signal processors 18*a*, 18*b* might function either in an analog or a digital domain. By means of respective output conditioners 22*a*, 22*b* signals are presented to respective output devices, speakers or receivers 24*a*, 24*b* associated with each of the user's ears.

Signal path 10*a* could be implemented by circuitry carried or worn at one of the user's ears. Signal path 10*b* could be implemented or worn at the other of the user's ears. Together these two signal paths produce coupled binaural signals wherein wireless transmission between the two signal paths is utilized to improve user convenience and wearability.

Figure 2:
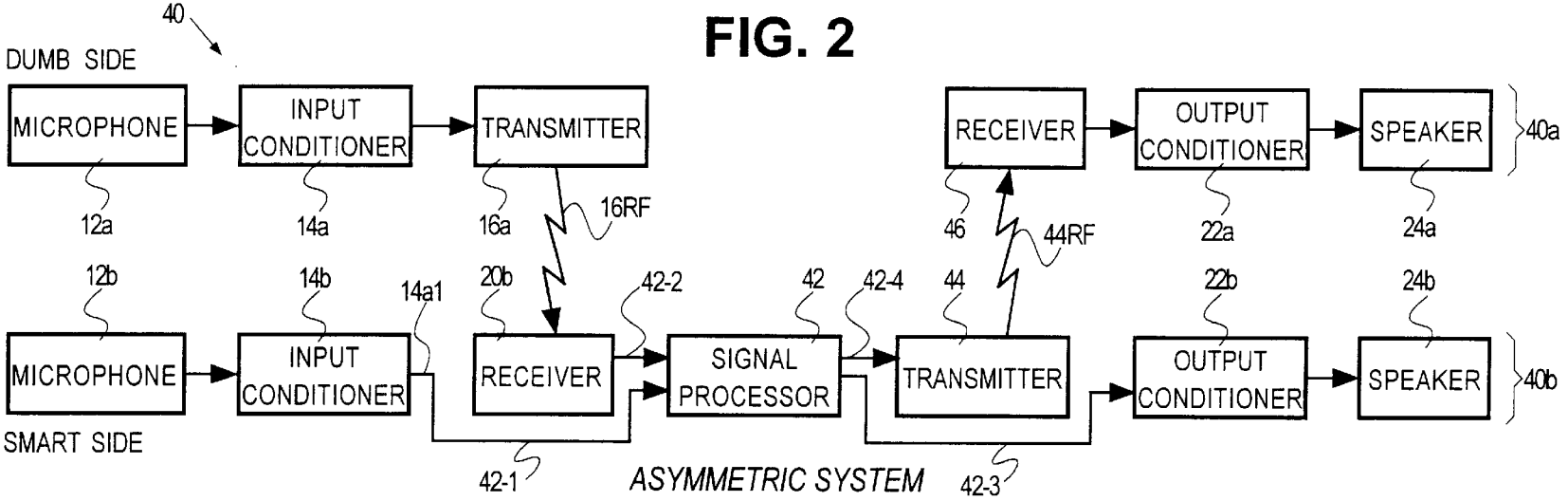
FIG. 2 is a block diagram schematic of an asymmetric binaural system which incorporates a single signal processor.

FIG. 2 illustrates an alternate binaural system 40 which incorporates a single signal processor. Those elements of the system 40 which correspond to the previously discussed elements of system 10 are numbered accordingly and no further discussion thereof is necessary. System 40 includes two units 40*a*, 40*b* linked by RF communication.

Unlike the system 10, the system 40 incorporates a single signal processor 42 which receives as inputs a conditioned local system from microphone 12*b* on a line 42-1 and demodulated signals from receiver 20*b* on a line 42-2. The signals on the lines 42-1 and 42-2 are processed to produce a local output on a line 42-3 and a remote output on a line 42-4.

The remote output on the line 42-4 is coupled by an RF transmitter 44 to the signal path 40*a*. Those signals are received from RF receiver 46 which in turn demodulates them and transfers them to conditioner 22*a* and subsequently to output transducer 24*a*.

Local process signals on the line 45-3 are in turn transmitted in signal path 40*b* via output conditioner 22*b* to output transducer 24*b*.

The system 40 not only has an advantage in that it only requires a single signal processor 42, but it also in that processor 42 is able to completely control the relationship and signal parameters associated with the two outputs on the lines 42-3 and 42-4.

Figure 3:
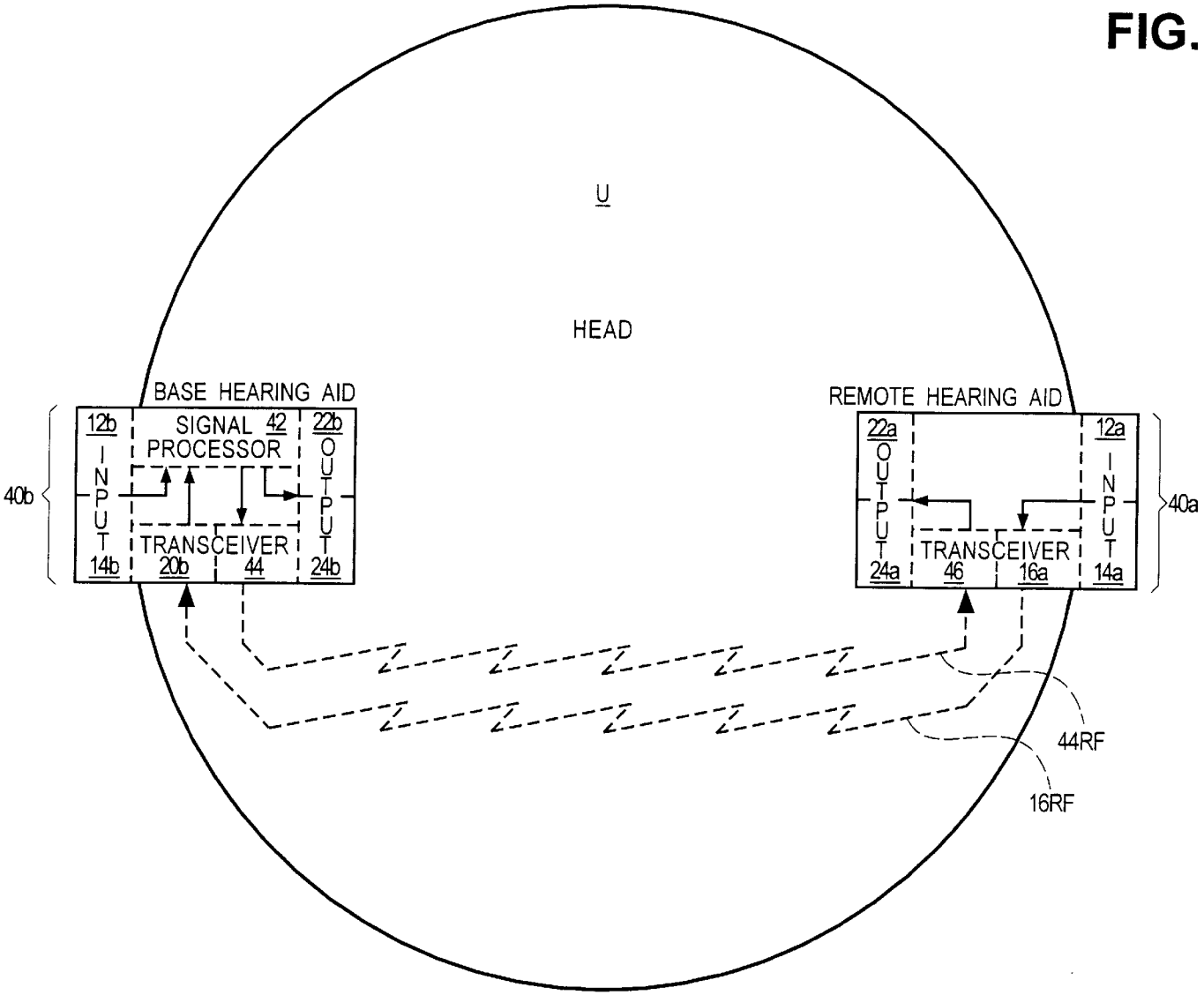
FIG. 3 is a schematic top plan view of an individual using an asymmetric binaural system of the type illustrated in FIG. 2.

FIG. 3 illustrates a user U wearing the system 40. Signal path 40*a* is associated with one side of the user's head and worn thereon. Signal path 40*b* is associated with the other side of the user's head and worn thereon.

While FIGS. 1 and 2 illustrate systems which provide for both bilateral inputs and binaural outputs, it will be understood that the system 40 could be implemented with a monaural output. In this implementation, the signal path 40*b* would include an output transducer, 24*b*. However, the signal path 40*a* would not include receiver 46, conditioner 22*a* or output transducer 24*a*. Hence, the revised system 40' described above would process inputs from two spaced apart microphones or input transducers 12*a*, 12*b* but only produce a single output at output transducer 24*b*.

The signal processing circuitry, such as signal processor 42, as will be understood, could be implemented as digital processing circuitry. Analog to digital converters may be included in the input conditioners 14 or the signal processor 42 for the purpose of transforming the analog signals from input transducers 12*a*, 12*b* into digital representations thereof prior to the processing. It will also be understood that various types of signal processing can be employed by the processing unit 42 without departing from the spirit and scope of the present invention. In one aspect, the processor 42 can carry out a substraction step which will subtract a first signal from a second signal. The signals could both be unfiltered input signals received from the transducers 12*a*, 12*b* for example. Alternately, the signal processor can subtract an unfiltered signal from a filtered signal.

It will also be understood that the communications link formed by the transmitter 16*a* and receiver 20*b* could be replaced by other forms of wireless links. Alternately, without departing from the spirit and scope of the present invention, the wireless link RF as well as 44RF could be replaced with a wired communication link.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A hearing aid comprising:

a first unit having a first acoustic input transducer, a first acoustic output transducer, a wireless receiver, and a digital signal processor receiving inputs from the first input transducer and the receiver and providing an output coupled to the output transducer:

a second unit having, a second acoustic input transducer and a transmitter wherein signals associated with the second input transducer are coupled to the transmitter and wirelessly transmitted to the receiver in the first unit;

said second unit including a second wireless receiver and a second output transducer wherein the second unit wirelessly receives signals from the first unit;

wherein the signal processor includes circuitry for processing inputs derived from both input transducers for generating first and second output signals wherein one of the output signals is coupled to the output transducer in the first unit by a wired link and the other output signal is coupled to the output transducer in the second unit by a wireless link.

2. A hearing aid as in claim 1 wherein the digital signal processor includes circuitry for forming a difference between the signals derived from the two output transducers.

3. A hearing aid as in claim 2 wherein one or both signal inputs to the distal signal processor is filtered before forming the difference.

4. A bilateral hearing instrument comprising:

a first device having:

a first audio input transducer coupled to a transmitter port of a transceiver; and a second device having:

a second audio input transducer coupled, as an input, to a signal processor, a second wireless transceiver in wireless reception with the first transceiver with an output coupled as an input to the signal processor wherein the signal processor includes circuitry for forming, in response to both inputs, representations of first and second processed audio output signals;

a transmitter input port of the second wireless transceiver coupled to the first representation and in wireless communication with a first receiver input port of the transceiver, a second acoustic output device coupled to the second audio output signal whereby a single signal processor generates the representations of the first and second audio output signals.

5. An instrument as inclaim 4 wherein the signal processor comprises a digital signal processor.

6. An instrument as in claim 5 wherein the digital signal processor includes circuitry for subtracting representations of the inputs.

7. An instrument as in claim 4 wherein the first device includes a first housing which carries the first input transducer, the first output device, and the first transceiver wherein the second device includes a second housing which carries the second input transducer, the signal processor, the second output device and the second transceiver to thereupon provide a dual housing, electrically asymmetrical bilateral instrument.

8. An asymmetrical, bilateral hearing instrument comprising:

a first housing which carries, a first microphone;

conditioning circuitry coupled to the first microphone;

a signal processor coupled to the circuitry;

a wireless receiver element for wirelessly receiving signals from a transmitter element wherein the receiver is coupled to the signal processor wherein the signal processor, in response to both of the inputs, generates a local output and a remote output;

a second transmitter element coupled to the remote output for wirelessly transmitting representations of the remote output to a second receiver element;

output circuitry coupled to the local output and a first audio output device; and a second housing which carries:

the transmitter element;

the second microphone;

conditioning circuitry coupled to the second microphone wherein the conditioning circuitry is coupled to an output port of the transmitter element wherein the transmitter wirelessly transmits representations of acoustic signals incident on the second microphone to the wireless receiver of the first housing;

the second receiver element whereat transmitted representations of the remote output are received from the first housing;

output circuitry coupled to an output port of the second receiver and to a second audio output device wherein only the signal processor of the first housing processes signals from both microphones to thereby generate the representations of different audio output signals to be produced by the two output devices.

9. A hearing instrument for providing processed signals to both ears of a user comprising:

first and second microphones;

a single speech processor; and first and second audio output transducers wherein a respective microphone and output transducer are carried adjacent to one another and positionable at a respective ear of the user wherein the processor is physically displaced from one of the microphones but not the other wherein input signals from both microphones are coupled to the processor and wherein the processor includes circuitry for forming first and second processed outputs, responsive to the input signals, whereby one of the processed outputs, associated with the displaced microphone, is wirelessly coupled to the respective transducer and wherein the other processed output is coupled to the other output transducer by a conductive element thereby providing processed audio output to both ears of the user.

10. A hearing instrument as inclaim 9 wherein a transceiver is coupled to the displaced microphone and to the respective output transducer to transmit microphone generated signals to the speech processor and to wirelessly receive one of the processed outputs for the transducer.

11. A hearing instrument as in claim 9 wherein the processor comprises a digital speech processor.

12. A hearing instrument as in claim 11 having a first housing for the first microphone and the first transducer and a second, different, housing for the second microphone, the second transducer and the digital speech processor.

13. A hearing instrument as in claim 9 wherein the processor is adjacent to the other output transducer.

* * * * *